US006305458B1

(12) United States Patent
Gligor

(10) Patent No.: US 6,305,458 B1
(45) Date of Patent: Oct. 23, 2001

(54) LOST FOAM AND SAND CORES STAGE MANUFACTURING TECHNOLOGY

(75) Inventor: Corneliu Ioan Gligor, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/526,324

(22) Filed: Mar. 15, 2000

Related U.S. Application Data

(60) Provisional application No. 60/124,898, filed on Mar. 17, 1999.

(51) Int. Cl.[7] ..... B22C 9/22
(52) U.S. Cl. ..... 164/34; 164/28
(58) Field of Search ..... 164/34, 28, 30, 164/32, 108, 112

(56) References Cited

U.S. PATENT DOCUMENTS

| | | | |
|---|---|---|---|
| Re. 31,488 | 1/1984 | Trumbauer . | |
| 3,889,737 | 6/1975 | Olsen . | |
| 4,078,598 | 3/1978 | Kelso et al. . | |
| 4,243,093 | 1/1981 | Nieman | 164/96 |
| 4,285,385 | 8/1981 | Hayashi et al. | 164/9 |
| 4,462,453 | 7/1984 | Trumbauer | 164/32 |
| 4,691,754 | 9/1987 | Trumbauer et al. . | |
| 4,736,786 | 4/1988 | Trumbauer et al. . | |
| 5,027,878 | 7/1991 | Revankar et al. | 164/98 |
| 5,063,992 | 11/1991 | Mrdjenovich et al. . | |
| 5,372,176 | 12/1994 | Brown et al. | 164/34 |
| 5,755,271 | 5/1998 | Williamson . | |

*Primary Examiner*—Tom Dunn
*Assistant Examiner*—Len Tran
(74) *Attorney, Agent, or Firm*—Bracewell & Patterson, L.L.P.

(57) ABSTRACT

A method of casting a workpiece having internal cavities uses a combination of sand core and lost foam techniques. A core of bonded granular material in the desired configuration of the voids of the workpiece is formed. The core has oppositely facing first and second surfaces with a pattern of channels extending between them. The pattern of the channels is in the desired configuration of walls for the cavities of workpiece. A first foam layer of destructible material is preformed and secured to the first surface of the core overlying one side of the channels. A second foam layer of destructible material is preformed and secured to the second surface of the core, overlying an opposite side of the channels. The assembly is placed in a refractory mold cavity, and granular refractory material is packed around the assembly. Molten metal is poured into the mold cavity into contact with the first and second foam layers, which decompose, causing the molten metal to flow into the channels, forming metal walls for the workpiece in the channels and in the spaces previously occupied by the foam layers.

16 Claims, 3 Drawing Sheets

LOST FOAM AND SAND CORES STAGE MANUFACTURING TECHNOLOGY

RELATED APPLICATION

Applicant claims priority to provisional application Ser. No. 60/124,898 filed Mar. 17, 1999.

TECHNICAL FIELD

The present invention relates to a foundry tooling process and method using destructible material in casting operations for producing complex internal shapes requiring a high degree of surface finish. More particularly, the invention relates to a process for producing impellers and diffusers for centrifugal submersible pumps.

BACKGROUND OF THE INVENTION

Many cast parts require the formation of voids therein. An example of such castings includes impellers of pump stages in centrifugal submersible pumps.

One method for forming such castings is the lost foam method. In the lost foam method, consumable patterns, such as polystyrene foam plastic, are coated with a permeable refractory wash and then embedded in foundry sand to be replaced by molten metal. The molten metal vaporizes the foam-type pattern and a metal duplicate of the pattern is the result. The lost foam method is advantageous because it allows for net shape capacity, i.e., the ability to produce a finished or near-finished casting that requires little or no machining. However, the lost foam method is unsuitable for the geometric particularities of the hydraulic passages required in complex castings, such as impellers and diffusers. The lost foam process is not suitable to form some complex castings because of process shortcomings including limitations in thickness of the walls as well as major costs associated with tooling, low consistency in the molding stage, low surface finish and low compression strength. Additionally, particular types of geometries result in warping of the castings. Therefore, such castings do not achieve a near net shape.

Another method for forming castings is sand molding. Sand molding uses high strength chemically bonded sand. Sand molding is not a preferred choice to form net shape parts because of mold wall movement. Additionally, some specific requirements of sand molding may only be met by high quality foundries.

Therefore, it is desirable to develop a method that results in near net shape, that is low in cost, and that avoids the shortcomings of the lost foam process. One solution is proposed in U.S. Pat. No. 4,691,754, which teaches molding a destructible layer around a first core by placing the first core into a molding machine. Partially pre-expanded polystyrene pellets are applied to the core and fully expanded, via a steam expansion step. However, a drawback with this method is that the core is exposed to moisture during the steam expansion step. It is desirable to avoid exposing the core, which is typically hygroscopic, to moisture. If the core is exposed to moisture, molten metal will come in contact with the moisture absorbed by the core when the molten metal is poured into the core. The exposure of molten metal to moisture is undesirable.

SUMMARY OF THE INVENTION

A casting method that combines a lost foam method and a sand molding method provides desired benefits without undesirable effects. The present invention is a lost foam and sand core casting method that includes the step of forming a core of bonded granular material, preferably sand or ceramic, containing voids. The core has voids formed in it that have at least two exposed sides. A first layer of lost foam destructible material is then preformed in a separate mold, preferably by an injection process. Similarly, a second layer of lost foam destructible material is preformed.

The first foam layer is positioned on one side of the core, and the second foam layer is positioned on another side of the core. The layers are glued to the core, closing off the exposed sides of the voids formed in the core.

The assembly is attached to a down sprue and lowered in a mold cavity, which is then packed with a mold media that is preferably the same as the media of the core. The assembly is vibration compacted and/or vacuum compacted within the ceramic and/or sand media. The foam layers prevent entry of mold media into the voids. Molten metal is then delivered to the mold cavity to form the casting. The lost foam layers are gasified and replaced by the molten metal as it enters the mold. The voids in the core as well as the spaces previously occupied by the foam layers are filled with the advancing molten metal. After cooling, the cast component is removed from the mold cavity, and the material of the core, which is no longer bonded, is removed from the component.

DETAILED DESCRIPTION OF THE INVENTION

Figure 1:
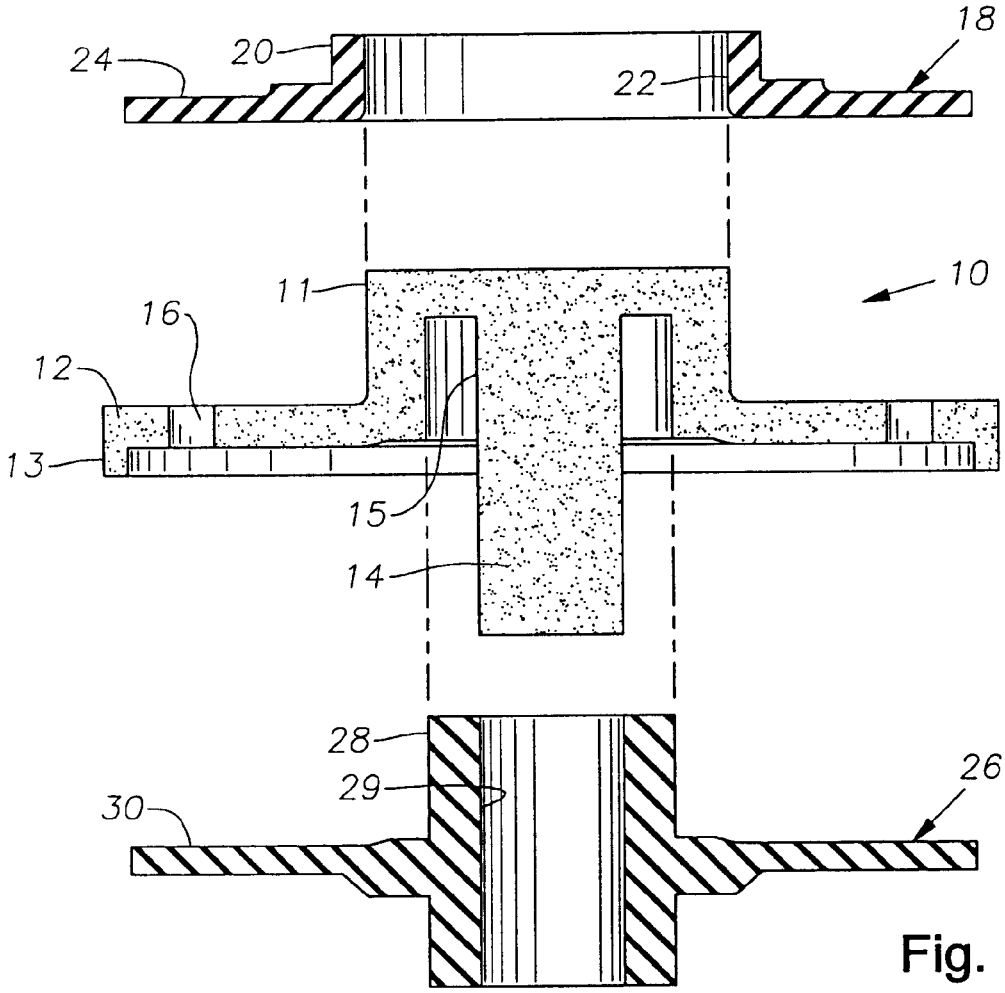
FIG. 1 is a cross-sectional, exploded and simplified elevation view of a core, an upper lost foam mold, and a lower lost foam layer constructed in accordance with this invention.
Figure 2:
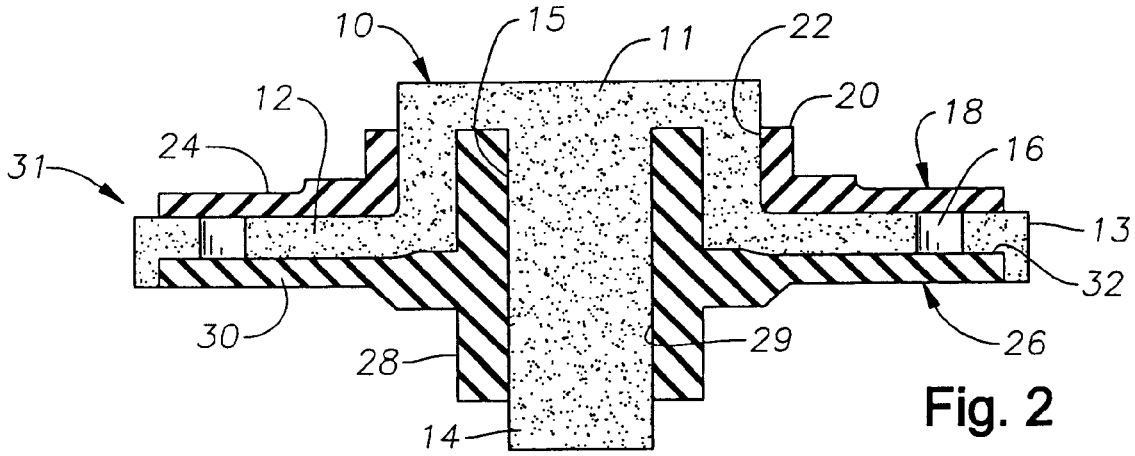
FIG. 2 is a cross-sectional and simplified elevation view of an assembly comprised of the core, upper lost foam layer, and lower lost foam layer of FIG. 1.

Referring now to FIGS. 1 and 2, core 10 is formed of a bonded granular material, preferably chemically bonded mullite. Mullite is a type of fine grade ceramic material. However, sand or other materials may be used, including silica sand and a binder such as phenolic base and/or modified phenolic base resin. Core 10 may be formed by a variety of conventional techniques. The material of the first core 10 should be compacted sufficiently to act as a backing that will generate enough mold strength in conjuncture with the mullite media to create a hydraulically sound part with a near net shape configuration.

Core 10 is shaped for forming cavities in a centrifugal pump impeller, and is shown in a simplified manner in FIG. 1, rather than with curved contours that would exist in practice. Core 10 is in a circular disk-shaped configuration with a central axis, an upward extending central cylindrical hub portion 11 and a radially extending flange 12. The terms "upper" or "upward" and "lower" or "downward" are used for convenience herein and not in a limiting manner. A depending lip 13 extends around the circumference of flange 12. A solid downward extending mandrel 14 extends from the lower side of core 10. An annular recess 15 with a closed upper surface is formed in the lower side of core 10, encircling mandrel 14.

Figure 4:
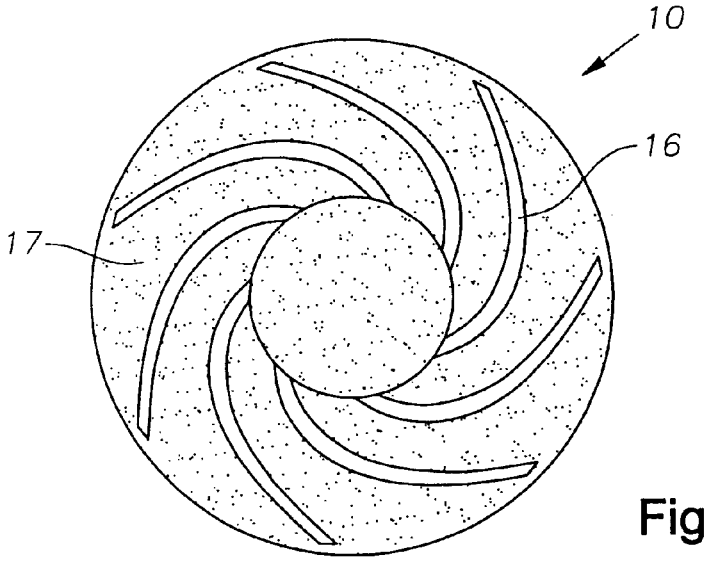
FIG. 4 is a top view of the core shown in FIGS. 1 and 2.

Flange 12 is formed with a plurality of voids or spaces 16 as shown in FIG. 4. Voids 16 extend from upper hub 11 outward in a spiral or helical pattern. Each void 16 extends completely through flange 12, and has an outer end that is closed by lip 13, which extends in a continuous uninterrupted circle around flange 12. Consequently, voids 16 have exposed upper and lower sides. Voids 16 are fairly thin in width and define fingers 17 in core 10 between them that are wider considerably than voids 16.

A protective core wash may be used to coat the surface of core 10 to enhance the surface finish of the casting. The particular core wash is customized for use with a particular alloy to minimize interaction and to meet specific permeability requirements as is known in the art.

An upper lost foam layer 18 is preformed of a cellular plastic foam material of a type that will vaporize when contacted by hot metal. The destructible material of upper lost foam layer 18 may be any type of suitable low temperature fusible substance, including a thermoplastic resinous material or any other cellular plastic material that gasifies substantially without residue. Materials that may be used include polystyrene and resinous polymerized derivatives of methacrylic acid. Various types of cellular plastic materials suitable for use in casting operations are taught in the following U.S. patents: U.S. Pat. No. 3,374,827, issued to Schlebler on Mar. 26, 1968, and U.S. Pat. No. 3,496,989, issued to Paoli on Feb. 24, 1970. The expression "destructible" as applied to the cellular plastic layer is intended to refer to materials that are quickly destroyed by molten metal. The destructible nature of the materials enables the molten metal to occupy the space originally occupied by the destructible material. In contrast, the "core" material is "non-destructible" in the sense that the core material is able to resist the effects of the molten metal. Therefore, the core material produces a cavity in the casting.

Upper lost foam layer 18 has a radially extending flat flange 24 and a central upward extending hub 20. Unlike flange 12 of core 10, there are no voids in flange 24, rather it is solid and has flat, smooth upper and lower surfaces. An opening 22 extends through hub 20 and is sized for close reception over upper hub portion 11 of core 10. The height of hub 20 of upper lost foam layer 18 is less than the height of upper hub 11 in the embodiment shown.

A lower lost foam layer 26 of the same material as upper lost foam layer 18 is also preformed. Lower lost foam layer 26 has a central hub 28 with a passage 29 extending through it. A flat circular flange 30 extends radially outward from hub 28 at a point between the upper and lower ends of hub 28. Flange 30 is also solid with substantially flat upper and lower surfaces. Hub 28 is sized to fit closely in recess 15. Mandrel 14 of core 10 fits closely within passage 29 and protrudes slightly below the lower end of hub 28.

Upper and lower foam layers 18, 26 may be preformed a variety of manners. Preferably, they are formed by injection molding techniques in an aluminum mold. Beads of cellular plastic material are injected into cavities in the aluminum mold, then expanded by the application of steam.

Figure 5:
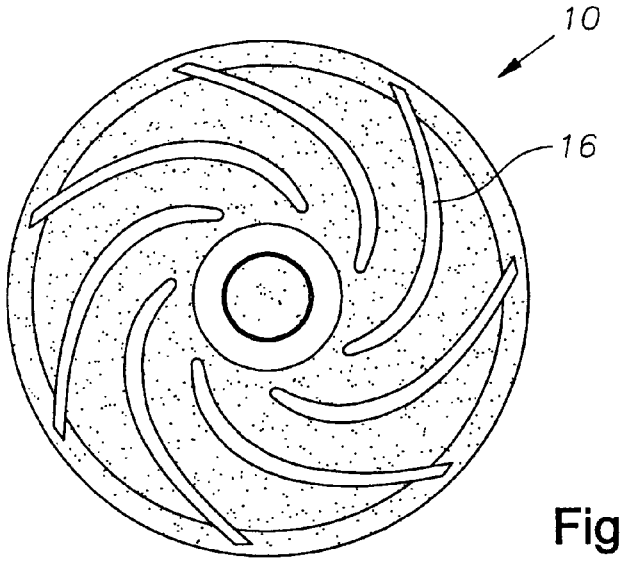
FIG. 5 is a bottom view of the core shown in FIGS. 1 and 2.

In practice, the preformed upper lost foam layer 18 is affixed to the upper side of the core 10, preferably by an adhesive, as shown in FIG. 2. The preformed lower lost foam layer 26 is positioned and affixed to the lower side of core 10 by adhesive, as shown in FIG. 2. The periphery of flange 30 locates within lip 13, and hub 28 extends into core recess 15. Once assembled as in FIG. 2, flange 24 of upper foam layer 18 will close the upper sides of voids 16 (FIGS. 4, 5), and flange 30 of lower foam layer 26 will close the lower sides of voids 16. Core lip 13 encloses the outer ends of voids 16. Voids 16 are thus completely sealed.

Figure 3:
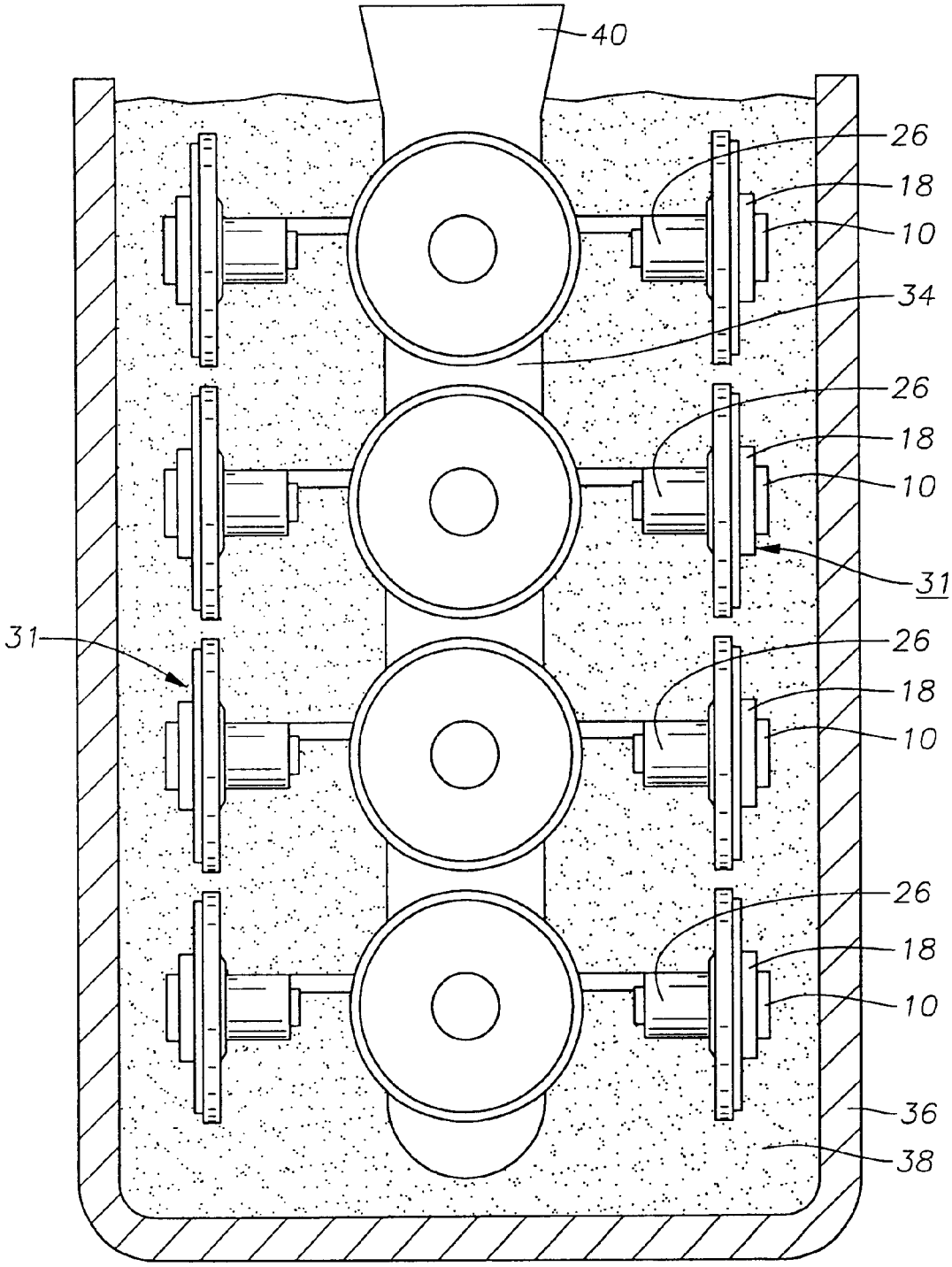
FIG. 3 is a side view of a plurality of the assemblies of FIG. 2 lowered into a molding flask on a down sprue.

The assembly 31 of core 10, and foam layers 18 and 26 are attached to a down sprue 34 (FIG. 3) and lowered into a flask 36. FIG. 3 shows eight of the assemblies 31 mounted to down sprue 34 and being simultaneously positioned in flask 36. A refractory molding media 38 is packed around assemblies 31. Molding media 38 is preferably the same as the material of core 10, such as ceramic mullite. The molding media 38 is unbonded and either vacuum and/or vibration compacted in place. The media 38 closely contacts and forms to the configuration of the assemblies 31.

Molten metal is then delivered to the assemblies 31 through a sprue cup 40 and down sprues 34 to form a casting of a workpiece or component, such as an impeller or diffuser. The upper lost foam layer 18 and lower lost foam layer 26 are gasified and replaced by the molten metal as it enters the mold. Voids 16 in core 10 (FIGS. 4 and 5) are also filled with the advancing molten metal. After cooling, the component is removed, and the granular media of core 10 is shaken from or otherwise removed from the component. This leaves a plurality of passages in the component where fingers 17 (FIGS. 4, 5) previously existed. Voids 16 resulted in lateral sidewalls being formed for the passages of the component, while foam layers 18, 26 resulted in upper and lower walls of the passages of the component.

Figure 6:
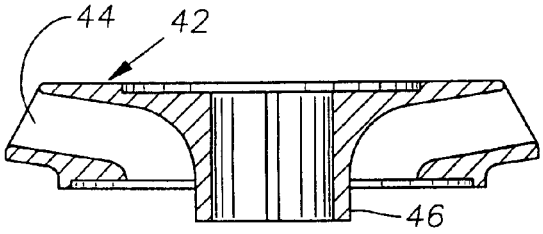
FIG. 6 is a cross-sectional view of a finished pump impeller formed from the assembly of FIG. 2.

An assembly similar to assembly 31, but more contoured, will form an impeller 42, shown in FIG. 6. Impeller 46 has helical passages 44 formed therein by fingers 17 (FIGS. 4, 5) of core 10 and upper and lower layers 18, 26. Impeller 42 has a hub 46 formed by corresponding portions of assembly 31.

Figure 7:
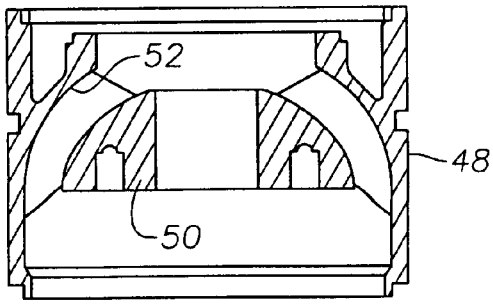
FIG. 7 is a cross-sectional view of a finished diffuser formed from a method in accordance with this invention.

An assembly (not shown) formed in the same manner, with a core of bonded granular material and upper and lower lost foam layers will also form a diffuser 48, shown in FIG. 7. Diffuser 48 has a central portion 50 and a plurality of passages 52 formed therein. Impeller 42 and diffuser 48 form a pump stage of a centrifugal pump.

The method of the invention has several advantages. By preforming the destructible material layers, then gluing the destructible material layers to a core, moisture from the steam expansion step never contacts the bonded granular material core. Additionally, the interior of the resulting casting is smooth-surfaced, free of pits and fins.

An important advantage is the use of voids in the core that are initially sealed by the foam layers, then filled with metal as the metal is introduced into the mold. The method of the invention requires no gluing lines that might occur when gluing two sand cores together. The absence of gluing lines results in an improved surface finish and dimensional stability. A casting with a complex internal geometry having a high level of surface finish may be formed. The result is a casting of complex internal geometry with a very high level of surface finish as cast, which yields improved hydraulic performance.

While the invention has been shown in only one of its forms, it should be apparent to those skilled in the art that it is not so limited, but is susceptible to various changes without departing from the scope of the invention.

What is claimed is:

1. A method of casting a workpiece having at least one cavity, comprising:

(a) preforming a core of bonded granular material in the desired configuration of the cavity of the workpiece, the core having at least one core cavity formed therein which has at least one exposed side;

(b) preformning a fusible member, then positioning the fusible member over the exposed side of said core cavity, forming an assembly;

(c) placing the assembly in a refractory mold cavity and packing granular refractory medial around the assembly, with the fusible member blocking entry of the refractory media into said core cavity, leaving said core cavity unfilled;

(d) delivering molten metal into the mold cavity into contact with the fusible member, which decomposes, causing the molten metal to flow into said core cavity, forming a metal wall of the workpiece in said core cavity and in the space previously occupied by the fusible member; then (e) removing the workpiece and the core from the mold cavity and removing the bonded granular material of the core from the workpiece.

2. The method according to claim 1, wherein the fusible member is secured adhesively to the core in step (b).

3. The method according to claim 1, wherein:

step (a) further comprises forming a recess in the core;

and step (b) further comprises preforming a protrusion on the fusible member of a shape that matches the recess and inserting the protrusion into the recess.

4. The method according to claim 1, wherein:

step (a) further comprises preforming a mandrel on the core; and step (b) further comprises preforming a hole in the fusible member and inserting the mandrel into the hole.

5. A method of casting a workpiece having at least one cavity therein, comprising:

(a) preforming a core of bonded granular material in the desired configuration of the cavity of the workpiece, the core having oppositely facing first and second surfaces with at least one core cavity extending between the first and second surfaces, said core cavity having exposed sides at the first and second surfaces and being in the desired configuration of a wall for the workpiece;

(b) preforming a first foam fusible member of fusible material, then positioning the first foam fusible member on the first surface of the core, overlying and closing off one of the exposed sides of said core cavity;

(c) preforming a second foam fusible member of fusible material, then positioning the second foam fusible member on the second surface of the core, overlying and closing off an opposite one of the exposed sides of said core cavity, forming an assembly of the first and second foam molds with the core, leaving said core cavity unfilled;

(d) placing the assembly in a refractory mold cavity and packing granular refractory material around the assembly;

(e) delivering molten metal into the mold cavity into contact with the first and second foam fusible members, which decompose, causing the molten metal to flow into said core cavity, forming a metal wall for the workpiece in said core cavity and in the spaces previously occupied by the foam fusible members; then (f) removing the workpiece and the core from the mold cavity and removing the bonded granular material of the core from the workpiece, providing the desired cavity for the workpiece.

6. The method according to claim 5, wherein in step (c), the foam fusible members are adhesively secured to the core.

7. The method according to claim 5, wherein in step (d) the molten metal flowing into said core cavity forms a side wall of the cavity of the workpiece, and the molten metal flowing into the spaces occupied by the first and second fusible members forms upper and lower walls of the cavity of the workpiece, the upper and lower walls being joined to each other by the side wall.

8. The method according to claim 5, wherein:

step (a) further comprises forming a recess in the second surface;

and step (c) further comprises preforming a protrusion on the second foam fusible member of a shape that matches the recess and inserting the protrusion into the recess.

9. The method according to claim 5, wherein:

step (a) further comprises preforming a mandrel on the second surface of the core; and step (c) further comprises preforming a hole in the second foam fusible member and inserting the mandrel into the hole.

10. A method of casting a centrifugal pump stage component having a plurality of a plurality of passages extending outward from a central axis, each of the passages being defined by sidewalls and first and second oppositely facing walls, the method comprising:

(a) forming a core of bonded granular material, having outward extending fingers separated by core cavities, each of the fingers being in the configuration of one of the passages of the component, and each of said core cavities being in the configuration of one of the sidewalls of the component, said core cavities having first and second exposed sides;

(b) preforming a first foam fusible member of fusible material, then positioning the first foam fusible member on a first surface of the core in contact with the fingers, overlying and closing off the first exposed sides of said core cavities, the first foam fusible member having portions in the configuration of the first walls of the passages of the component;

(c) preforming a second foam fusible member of fusible material, then positioning the second foam fusible member on a second surface of the core in contact with the fingers, overlying and closing off the second exposed sides of said core cavities, the second foam fusible member having portions in the configuration of the second walls of the passages of the component, the foam fusible members and the core forming an assembly, leaving said core cavities unfilled;

(d) placing the assembly in a refractory mold cavity and packing granular refractory material around the assembly;

(e) delivering molten metal into the mold cavity into contact with the first and second foam fusible members, which decompose, causing the molten metal to flow into said core cavities, forming sidewalls for the passages of the component in said core cavities and forming first and second walls for the passages in the spaces previously occupied by the foam fusible members; then (f) removing the component and the core from the mold cavity and removing the bonded granular material of the core from the component, providing the desired passages for the component.

11. The method according to claim 10, wherein in step (c), the foam fusible members are adhesively secured to the core.

12. The method according to claim 10, wherein in step (d) the molten metal flowing into said core cavities and spaces joins the sidewalls of the passages with the first and second walls of the passages.

13. The method according to claim 10, wherein:

step (a) further comprises forming a recess in the core;

and step (c) further comprises preforming a protrusion on the second foam fusible member of a shape that matches the recess and inserting the protrusion into the recess.

14. The method according to claim 10, wherein:

step (a) further comprises preforming a mandrel on the core; and step (c) further comprises preforming a hole in the second foam fusible member and inserting the mandrel into the hole.

15. The method according to claim 10, wherein in step (a), the fingers of the core are formed to extend outward in a spiral pattern.

16. The method according to claim 10, wherein in step (a), the fingers and the openings of the core are formed to extend outward in a spiral pattern, and wherein the core is formed with an annular lip surrounding outward ends of said core cavities and joining outward ends of the fingers.

* * * * *

UNITED STATES PATENT AND TRADEMARK OFFICE

CERTIFICATE OF CORRECTION

PATENT NO. : 6,305,458 B1
DATED : October 23, 2001
INVENTOR(S) : Corneliu Ioan Gligor It is certified that error appears in the above-identified patent and that said Letters Patent is hereby corrected as shown below:

Column 5,
Line 9, delete "medial" and insert -- media --.

Signed and Sealed this

Twenty-eighth Day of May, 2002

*Attest:*

*Attesting Officer*

JAMES E. ROGAN
*Director of the United States Patent and Trademark Office*